US010494857B2

(12) United States Patent
Meeks

(10) Patent No.: US 10,494,857 B2
(45) Date of Patent: Dec. 3, 2019

(54) THRESHOLD ASSEMBLY HAVING A RAIL WITH A DRAINAGE WALL DEFINING A DRAINAGE PASSAGEWAY

(71) Applicant: Quanex Homeshield, LLC, Mounds View, MN (US)

(72) Inventor: James W. Meeks, Eaton, OH (US)

(73) Assignee: Quanex Homeshield, LLC, Houston, TX (US)

( * ) Notice: Subject to any disclaimer, the term of this patent is extended or adjusted under 35 U.S.C. 154(b) by 141 days.

(21) Appl. No.: 15/730,099

(22) Filed: Oct. 11, 2017

(65) Prior Publication Data

US 2018/0100345 A1 Apr. 12, 2018

Related U.S. Application Data

(60) Provisional application No. 62/406,601, filed on Oct. 11, 2016.

(51) Int. Cl.
*E06B 1/70* (2006.01)
*E06B 7/14* (2006.01)

(52) U.S. Cl.
CPC ..... *E06B 1/70* (2013.01); *E06B 7/14* (2013.01); *E06B 2001/707* (2013.01)

(58) Field of Classification Search
CPC ..... E06B 1/70; E06B 7/14
See application file for complete search history.

(56) References Cited

U.S. PATENT DOCUMENTS 1,429,203 A * 9/1922 Hartstra ..... E06B 7/232 49/476.1
3,410,027 A * 11/1968 Bates ..... E06B 7/14 49/471
4,055,917 A * 11/1977 Coller ..... E06B 1/70 49/469
4,310,991 A * 1/1982 Seely ..... E06B 1/70 49/470

(Continued)

OTHER PUBLICATIONS

Aribell, "Aritech Canadian Sills—5⅝" Wide", 2016, 1 page.

(Continued)

*Primary Examiner* — Justin B Rephann
(74) *Attorney, Agent, or Firm* — Howard & Howard Attorneys PLLC

(57) ABSTRACT

A threshold assembly is used with an entryway system disposed within an aperture of a structure. The threshold assembly includes a sill extending along an axis between exterior and interior sides. The sill at least partially defines a sill channel between the exterior and interior sides which is adapted for accepting a fluid. The threshold assembly includes a rail coupled to and disposed above the sill base. The rail has a drainage wall adjacent the exterior side and at least partially defining the sill channel. The rail at least partially defines a rail channel between the exterior and interior sides, and above the sill channel, which is adapted for accepting the fluid. The rail defines a channel passageway. The drainage wall defines a drainage passageway. The rail channel, the channel passageway, the sill channel, and the drainage passageway at least partially define a drainage plane.

14 Claims, 8 Drawing Sheets

(56) References Cited

U.S. PATENT DOCUMENTS 4,686,793 A * 8/1987 Mills ..... E06B 7/2316 49/470
5,067,279 A * 11/1991 Hagemeyer ..... E06B 1/70 49/470
5,123,212 A * 6/1992 Dallaire ..... E06B 7/14 49/408
5,179,804 A * 1/1993 Young ..... E06B 1/70 49/468
5,687,508 A * 11/1997 Fitzhenry, Jr. ..... E06B 1/70 49/380
5,822,934 A * 10/1998 O'Donnell ..... E06B 7/14 52/209
5,887,387 A * 3/1999 Dallaire ..... E06B 7/26 49/408
5,956,909 A * 9/1999 Chou ..... E06B 7/2316 52/209
6,098,355 A * 8/2000 Li ..... E06B 3/4609 52/204.56
6,374,557 B1 * 4/2002 O'Donnell ..... E06B 7/14 160/44
7,600,346 B2 * 10/2009 Meeks ..... E06B 1/70 49/467
8,033,056 B2 * 10/2011 Wernlund ..... E06B 7/14 49/408
8,813,427 B2 8/2014 Meeks
2006/0150521 A1 * 7/2006 Henry ..... E06B 1/70 49/471
2008/0110100 A1 * 5/2008 Heppner ..... E06B 1/70 49/471
2009/0120005 A1 * 5/2009 Eckenswiller ..... E06B 7/14 49/408
2010/0300001 A1 * 12/2010 Wernlund ..... E06B 1/70 49/471
2013/0199100 A1 * 8/2013 Van Camp ..... E06B 1/70 49/468
2015/0159428 A1 * 6/2015 Johnson ..... E06B 7/14 49/471
2016/0138327 A1 * 5/2016 Margiotta ..... E06B 7/14 49/465

OTHER PUBLICATIONS

Lstiburek, Joseph, "BSD-105: Understanding Drainage Planes", Building Science Corporation, Oct. 24, 2006, 9 pages.
Door Com/Wintek Industries, "Sills-Fixed-Self Draining-In-Swing", downloaded from www.wintek.ca/noprice-Sills_FixedSelfDraining.htm on Oct. 4, 2017, 2 pages.
Quanex Building Products, "Top-Drain Sill Stops Water at the Door", 2016, 1 page.

* cited by examiner

THRESHOLD ASSEMBLY HAVING A RAIL WITH A DRAINAGE WALL DEFINING A DRAINAGE PASSAGEWAY

RELATED APPLICATIONS

This application claims priority to and the benefit of U.S. Provisional Patent Application No. 62/406,601, filed on Oct. 11, 2016, the entire contents of which are hereby incorporated by reference.

BACKGROUND OF THE INVENTION

1. Field of the Invention

The subject invention relates to a threshold assembly for an entryway system.

2. Description of Related Art

Entryway systems typically include a door bottom system. The door bottom system typically includes a door sweep coupled to and configured to move with a door panel of the entryway system and a threshold assembly to seal against the door sweep. The entryway system typically includes a door frame and the door panel. The door panel is pivotal relative to the door frame between open and closed positions. The threshold assembly typically includes a sill and a rail, with the rail disposed on the sill. The rail is disposed below the door sweep when the door panel is in the closed position. The rail engages the door sweep to create a water-tight seal between the rail and the door panel.

Traditionally, the rail has a continuous, flat, horizontal engagement surface which engages the door sweep. Any water that infiltrates between the door sweep and the rail is disposed on the engagement surface. The water may then easily flow off the rail into the interior of the structure. As such, there remains a need to provide an improved threshold assembly.

SUMMARY OF THE INVENTION AND ADVANTAGES

The subject invention provides for a threshold assembly for use with an entryway system disposed within an aperture of a structure, which has an exterior and an interior. The threshold assembly comprises a sill extending along an axis between an exterior side for facing the exterior of the structure and an interior side for facing the interior of the structure. The sill at least partially defines a sill channel between the exterior side and the interior side which is adapted for accepting a fluid therein.

The threshold assembly further comprises a rail coupled to and disposed above the sill base. The rail has a drainage wall adjacent the exterior side of the sill and cooperating with the sill to at least partially define the sill channel. The rail at least partially defines a rail channel between the exterior side and the interior side, and above the sill channel. The rail channel is adapted to accept the fluid therein.

The rail defines a channel passageway which fluidly connects the rail channel and the sill channel for permitting flow of the fluid from the rail channel to the sill channel. The drainage wall defines a drainage passageway fluidly connected with the sill channel for permitting flow of the fluid from the sill channel to the exterior side of the sill. The rail channel, the channel passageway, the sill channel, and the drainage passageway at least partially define a drainage plane for permitting flow of the fluid from the rail channel to the exterior side of the sill.

Accordingly, the threshold assembly directs the drainage of any fluid that reaches the rail off of the threshold assembly toward the exterior of the structure. As such, the threshold assembly prevents intrusion of the fluid into the interior of the structure, which is damaging to the interior of the structure, presents a slip hazard, and is generally undesired within the industry.

BRIEF DESCRIPTION OF THE DRAWINGS

Advantages of the subject invention will be readily appreciated as the same becomes better understood by reference to the following detailed description when considered in connection with the accompanying drawings.

DETAILED DESCRIPTION OF THE INVENTION

Figure 1:
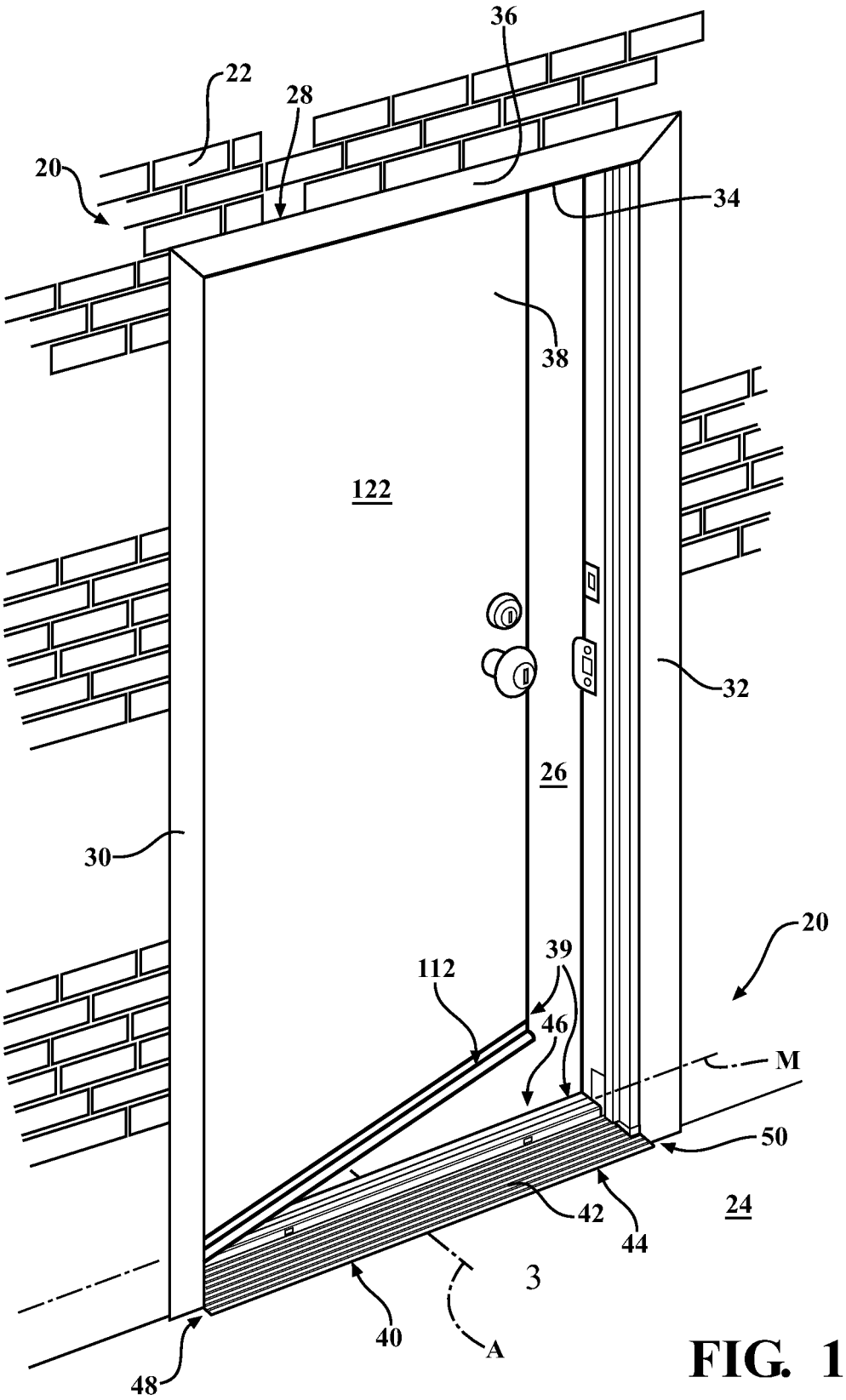
FIG. 1 is a perspective view of an entryway system having a door bottom system.

Referring to the Figures, wherein like numerals indicates like or corresponding parts throughout the several views; an entryway system 20 for disposing within an aperture of a structure 22 is generally shown in FIG. 1. The structure 22 is typically a building, such as a commercial or residential building, with the entryway system 20 providing access into the structure 22. The structure 22 has an exterior 24 and an interior 26. More specifically, the structure 22 has a wall dividing the exterior 24 (i.e., an outside environment) and the interior 26 of the structure 22. The entryway system 20 is disposed within the aperture to separate the exterior 24 and the interior 26 of the structure 22. Said differently, the exterior 24 and the interior 26 are disposed on opposite sides of the entryway system 20. As such, the entryway system 20 can be used to access the exterior 24 from the interior 26 of the structure 22 and, alternatively, the entryway system 20 can be used to access the interior 26 from the exterior 24 of the structure 22. It is to be appreciated that the entryway system 20 may be utilized in any suitable configuration for providing access through the wall of the structure 22.

The entryway system 20 typically comprises a door frame 28 disposed in the aperture of the structure 22. The door frame 28 comprises first and second door jambs 30, 32 spaced from each other. The door frame 28 defines an opening 34 for providing access between the interior 26 and the exterior 24 of the structure 22. Typically, the first and second door jambs 30, 32 are substantially parallel to one another. However, it is to be appreciated that the first and second door jambs 30, 32 may be disposed transverse to one another or in any other suitable configuration. The door frame 28 typically comprises a door head 36 transverse to and extending between the first and second door jambs 30, 32.

Figure 7:
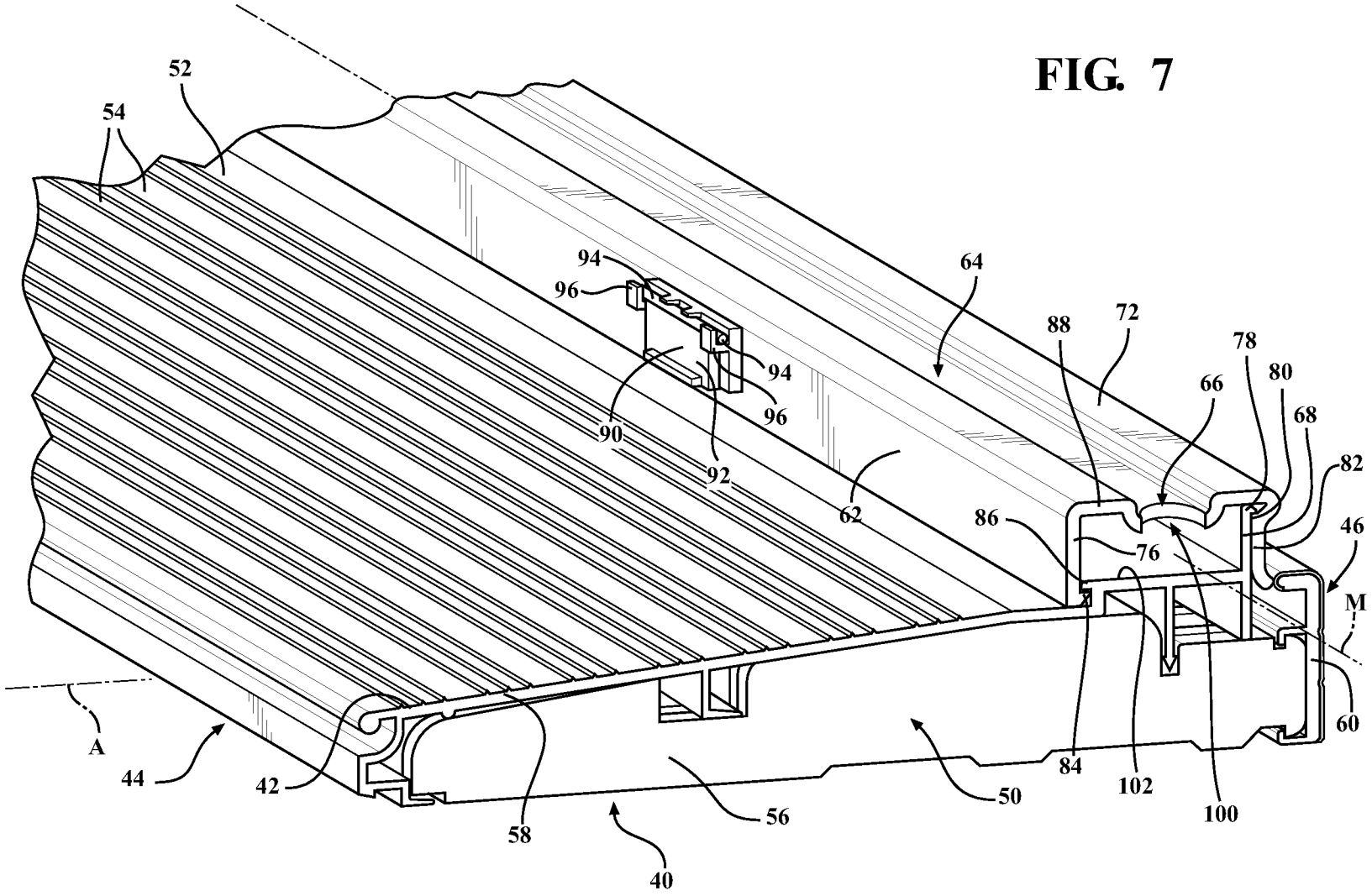
FIG. 7 is a perspective view of the door bottom system and the door panel in the open position, showing the cover plates covering the drainage passageways.
Figure 8:
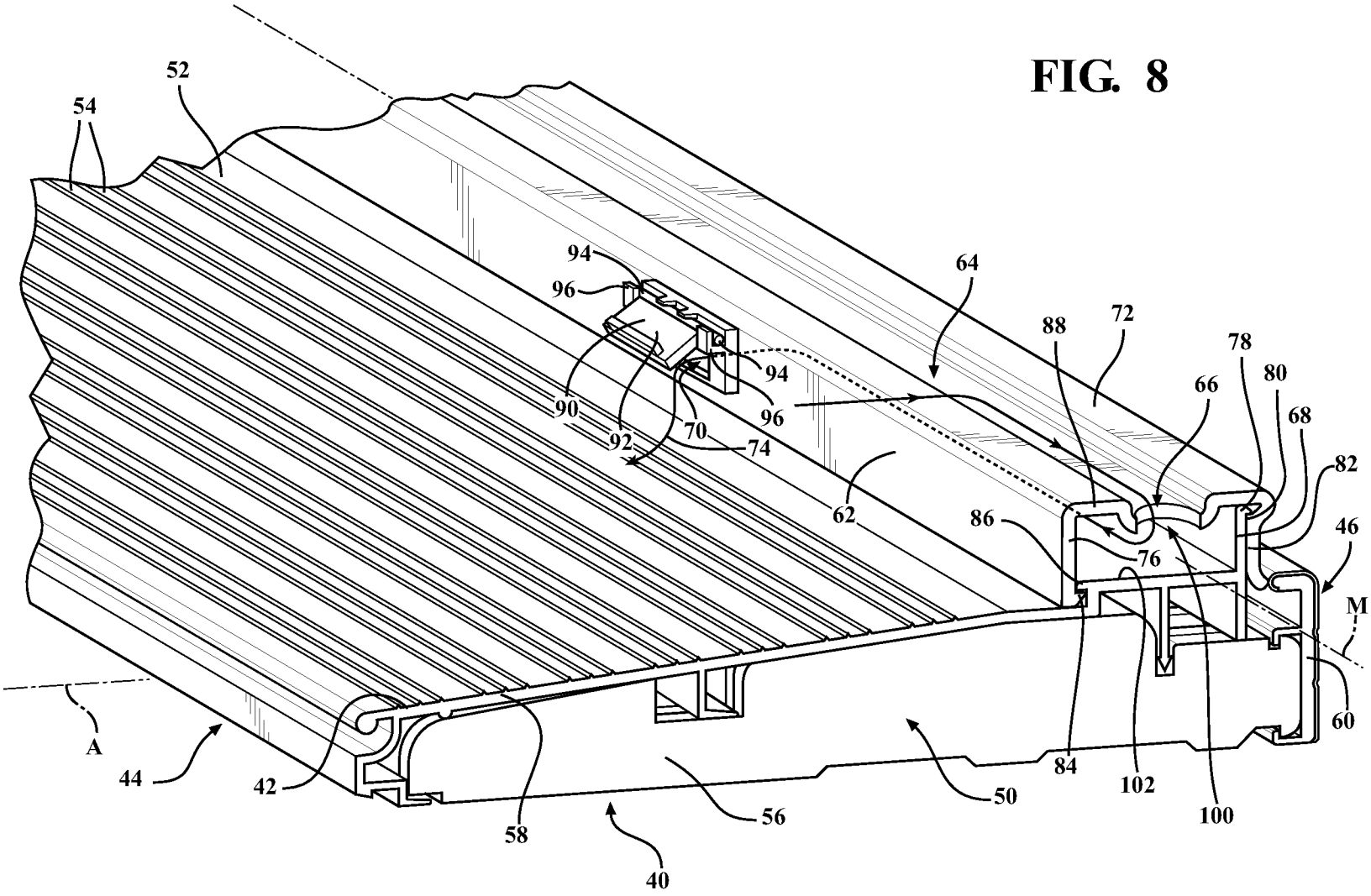
FIG. 8 is a perspective view of the door bottom system and the door panel in the open position, showing the cover plates uncovering the drainage passageways.

The entryway system 20 comprises a door panel 38. The door panel 38 is typically coupled to the door frame 28 and is capable of moving between an open position, as shown in FIGS. 5, 7, and 8, and a closed position, as shown in FIGS. 1-4 and 6. When in the closed position, the door panel 38 is disposed in the opening 34. The door panel 38 is typically pivotally coupled to one of the first and second door jambs 30, 32. The door panel 38 is pivotally coupled to the first door jamb 30 in the Figures for exemplary purposes only. The movement of the door panel 38 between the open and closed positions may be further defined as pivoting between the open and closed positions. Said differently, the door panel 38 is hinged to one of the first and second door jambs 30, 32. The door panel 38 is disposed entirely outside of the opening 34 in the open position. The closed position refers to any position of the door panel 38 in which at least a portion of the door panel 38 extends into the opening 34, as shown in FIGS. 1-4 and 6. The closed position may further define a completely closed position in which the door panel 38 is entirely disposed within the opening 34, as shown in FIGS. 2-4 and 6. In the completely closed position, the door panel 38 may abut the door frame 28 to substantially inhibit access through the opening 34.

As shown in FIGS. 1-4 and 6, the entryway system 20 comprises a door bottom system 39. The door bottom system 39 comprises a door sweep 112 disposed below and adapted to be coupled to the door panel 38. The door sweep 112 is movable between first and second positions corresponding with the open and closed positions of the door panel 38, respectively.

Figure 2:
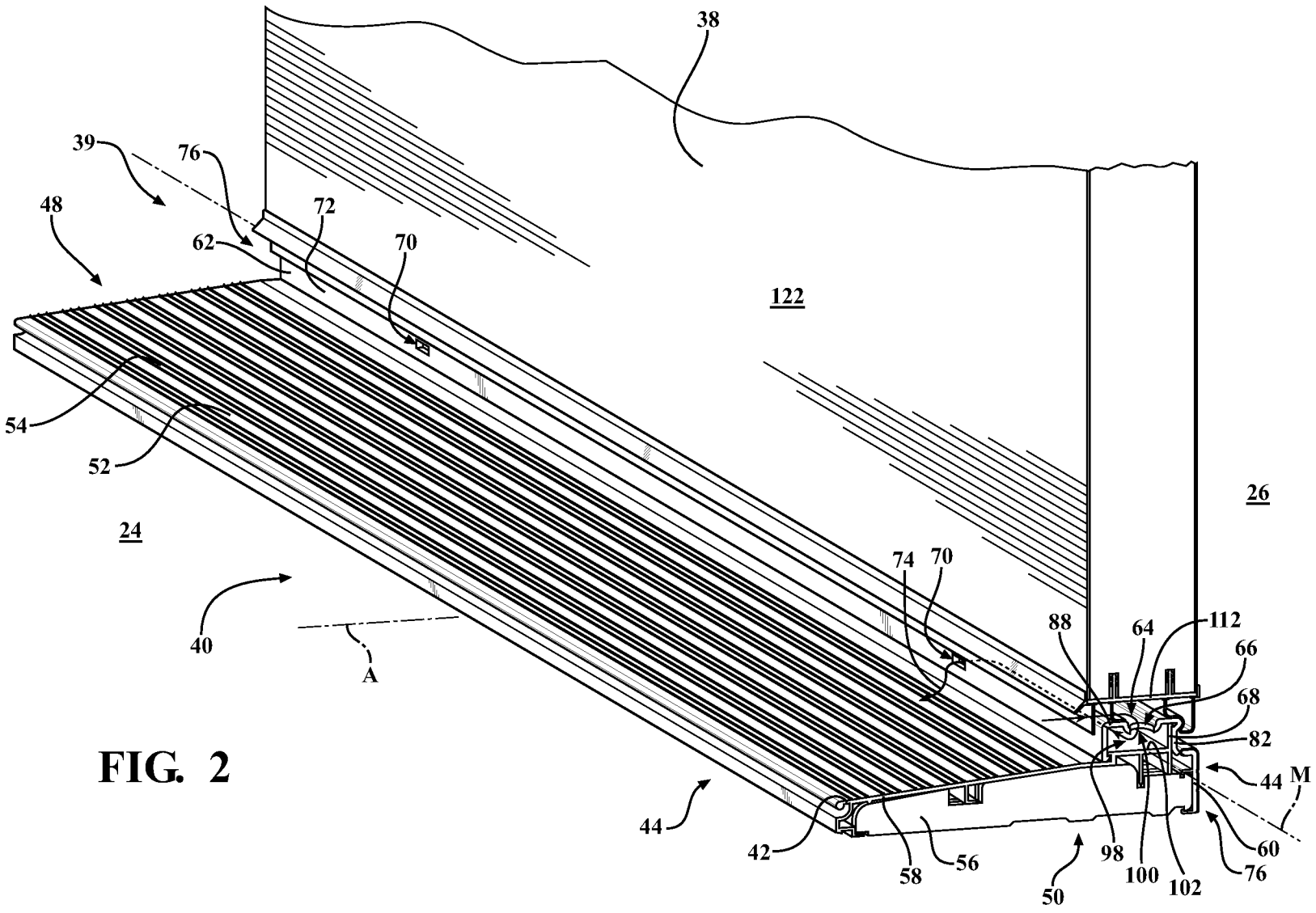
FIG. 2 is a perspective view of the door bottom system and a door panel in a closed position.
Figure 6:
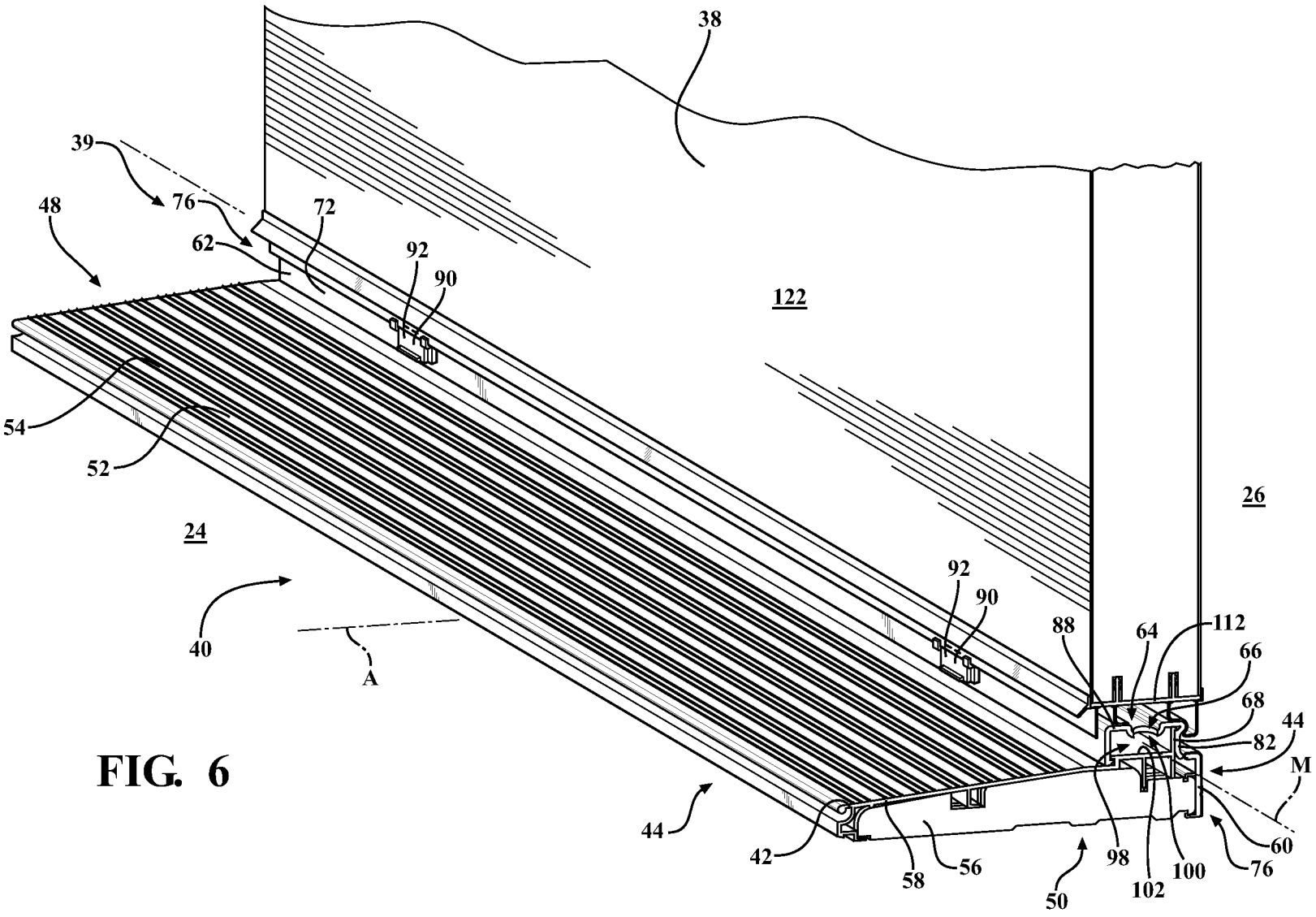
FIG. 6 is a perspective view of the door bottom system and the door panel in the closed position, showing the threshold assembly further comprising cover plates covering the drainage passageways.

As shown in FIGS. 2 and 6, the door bottom system 39 comprises a threshold assembly 40 disposed below the door sweep 112 in the second position. The threshold assembly 40 comprises a sill 42 extending along an axis A between an exterior side 44 for facing the exterior 24 of the structure 22 and an interior side 46 for facing the interior 26 of the structure 22. The sill 42 at least partially defines a sill channel 98 between the exterior side 44 and the interior side 46 which is adapted for accepting a fluid therein.

As set forth in the present application, the fluid is typically water. However, it is to be appreciated that the fluid may be any particular fluid, which may or may not comprise any debris entrapped therein.

The threshold assembly 40 comprises a rail 72 coupled to and disposed above the sill 42, with the rail 72 having a drainage wall 62 adjacent the exterior side 44 of the sill 42 and cooperating with the sill 42 to at least partially define the sill channel 98. The rail 72 at least partially defines a rail channel 64 between the exterior side 44 and the interior side 46, and above the sill channel 98. The rail channel 64 is adapted to accept the fluid therein.

Figure 3:
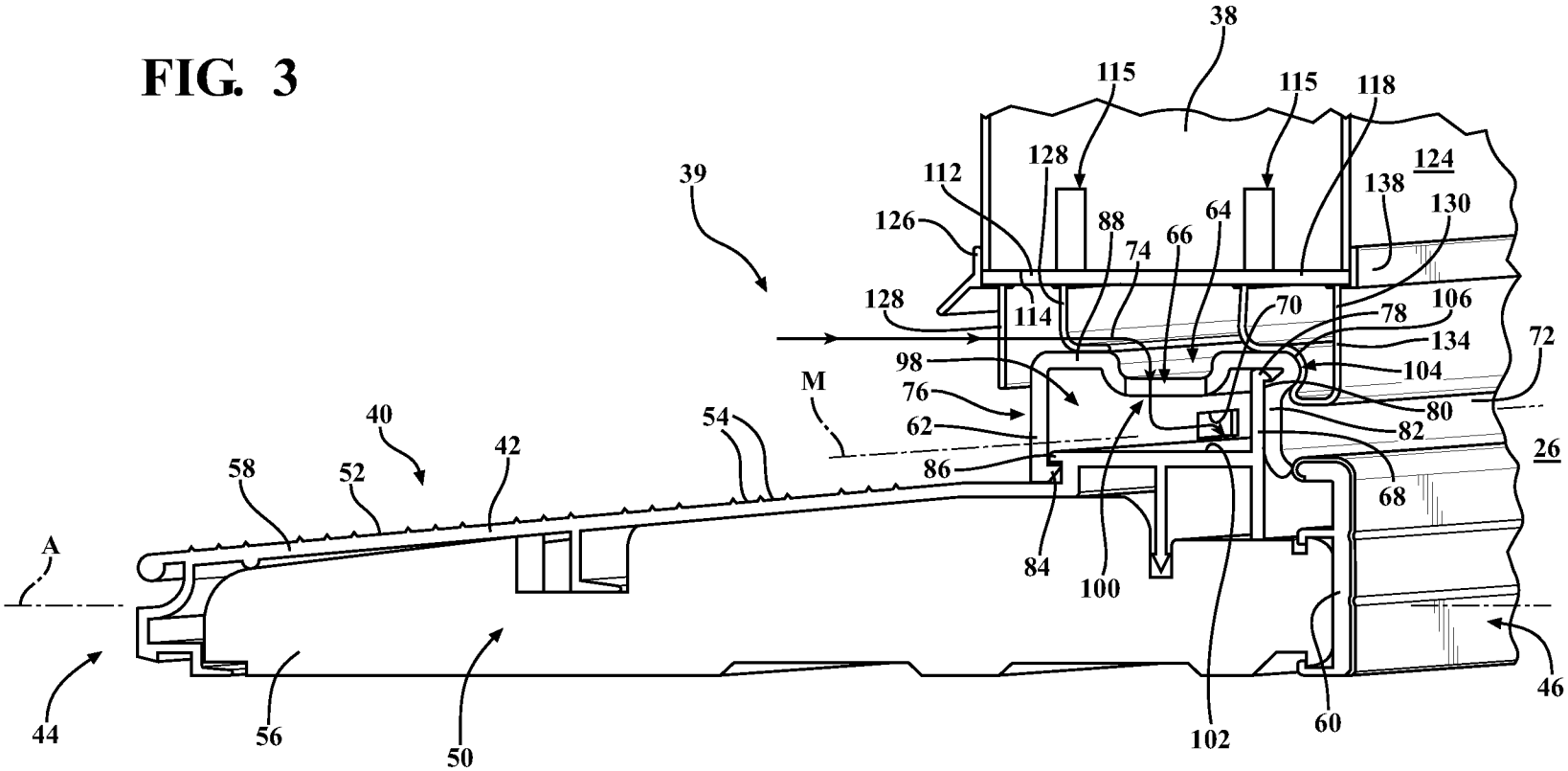
FIG. 3 is a perspective view of the door bottom system and the door panel in the closed position, showing a threshold assembly having a rail which defines a channel passageway and a drainage passageway.
Figure 4:
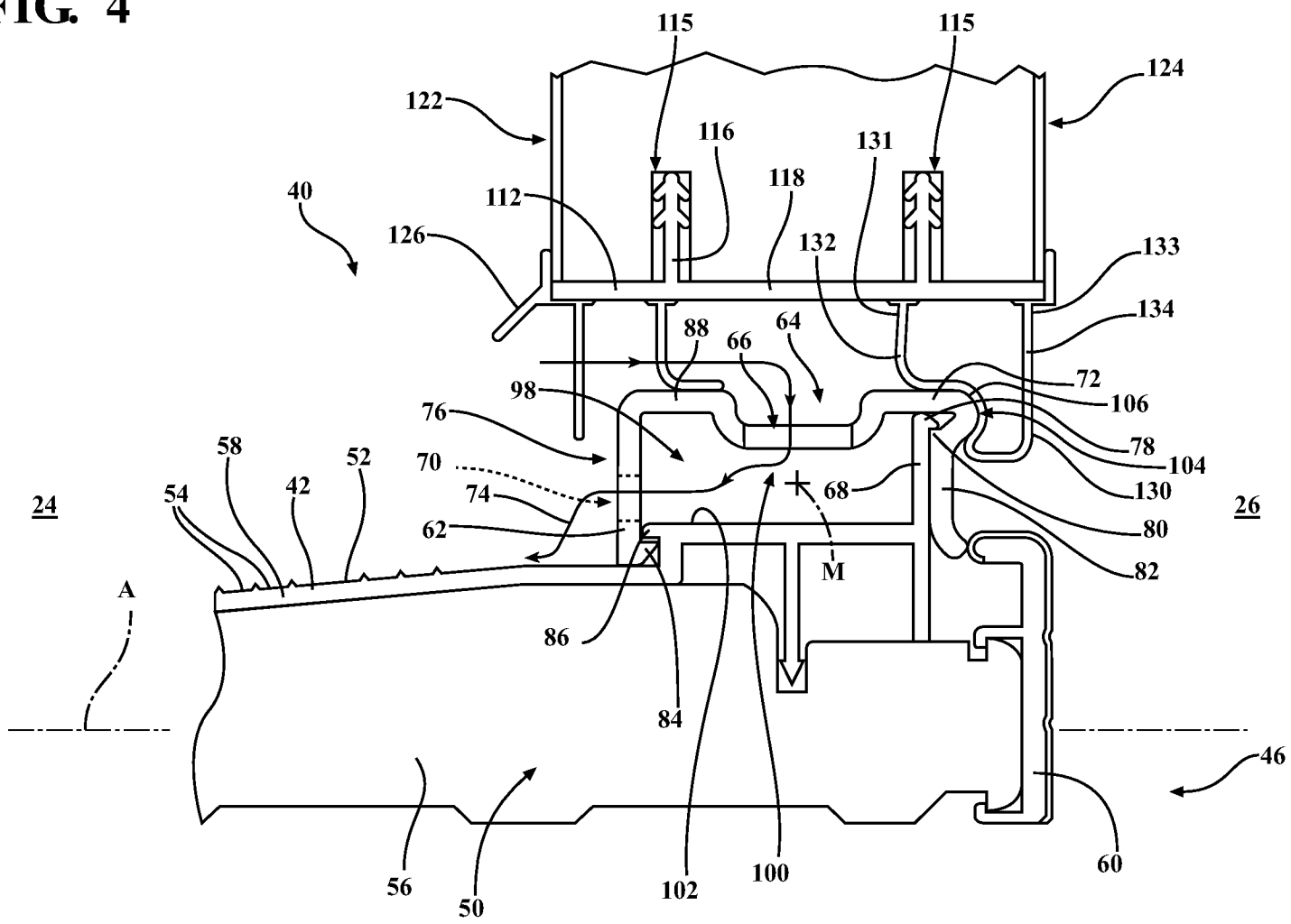
FIG. 4 is a side view of the door bottom system and the door panel in the closed position.
Figure 5:
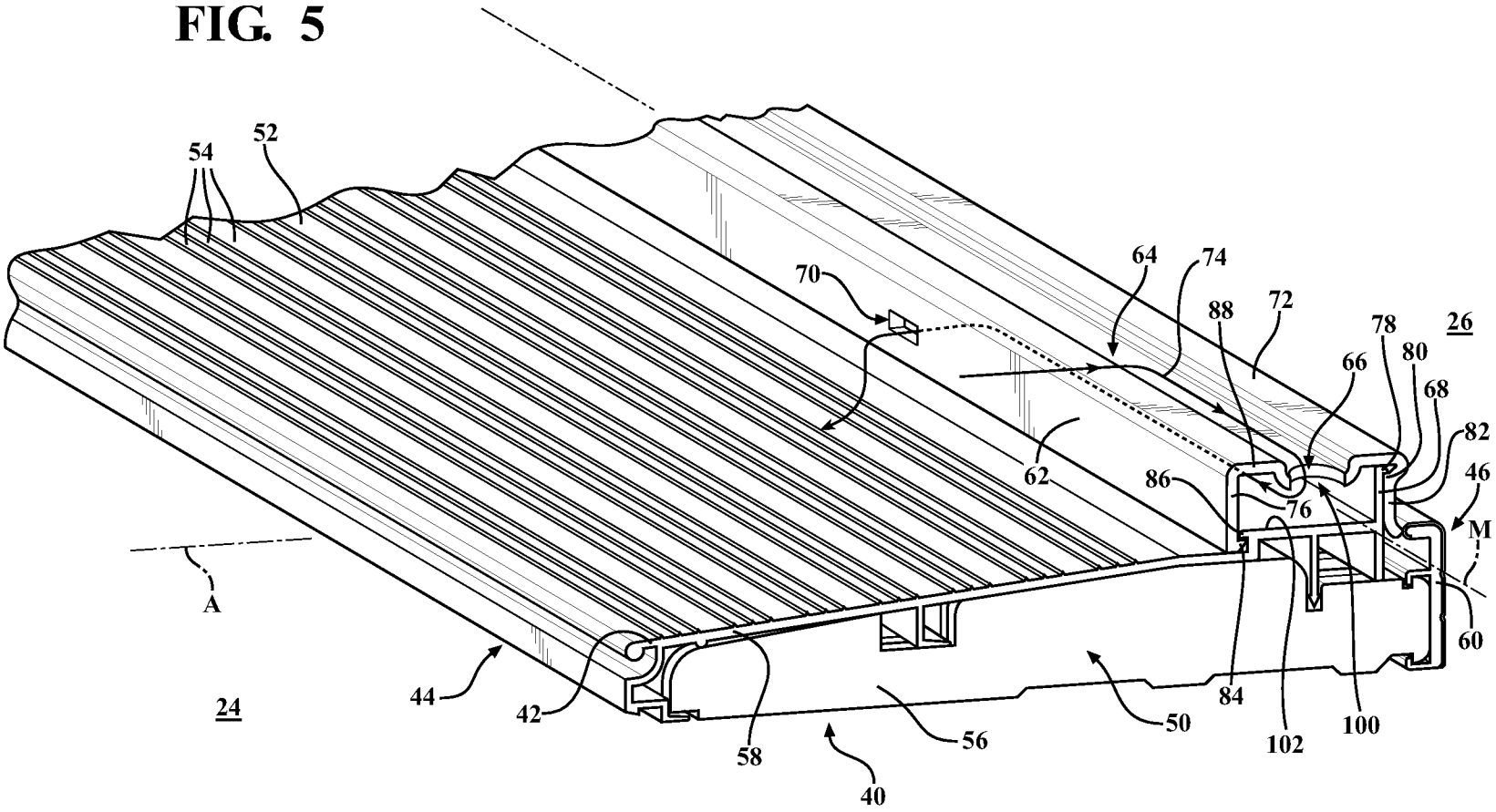
FIG. 5 is a perspective view of the door bottom system and the door panel in an open position.

As shown in FIGS. 3 and 4, the rail 72 defines a channel passageway 66 which fluidly connects the rail channel 64 and the sill channel 98 for permitting flow of the fluid from the rail channel 64 to the sill channel 98. As shown in FIGS. 4 and 5, the drainage wall 62 defines a drainage passageway 70 fluidly connected with the sill channel 98 for permitting flow of the fluid from the sill channel 98 to the exterior side 44 of the sill 42. The rail channel 64, the channel passageway 66, the sill channel 98, and the drainage passageway 70 at least partially define a drainage plane 74 for permitting flow of the fluid from the rail channel 64 to the exterior side 44 of the sill 42.

As set forth in the present application, the term drainage typically refers to movement of the fluid. However, it is to be appreciated that the drainage may refer to the movement of any fluid, comprising any debris that may be entrapped within the fluid. Furthermore, drainage may also refer to the movement of any object that is desired to be removed from the threshold assembly 40.

A person having ordinary skill in the art will appreciate that a drainage plane 74 is a fluid flow path defined by a mechanism, material, or the like which facilitates the drainage of fluid toward an exterior of the structure that has penetrated past an exterior surface of an object that separates the interior and interior of the structure. In the present application, the object referred to is the entryway system 20; more specifically, the door bottom system 39 comprising the threshold assembly 40 and the door sweep 112, with the exterior surface of the door bottom system 39 being defined as portions of the threshold assembly 40 and the door sweep 112 which face the exterior 24 of the structure 22 when the door panel 38 is in the completely closed position. The delineation of the exterior surface of the door bottom system 39 between the threshold assembly 40 and the door sweep 112 is the first point of contact between the threshold assembly 40 and the door sweep 112 adjacent the exterior 24 of the structure 22 when the door panel 38 is in the completely closed position. For example, the door sweep 112 may comprise at least one fin 128 engageable with the rail 72 when the door panel 38 is in the completely closed position, with the engagement of the at least one fin 128 with the rail 72 defining the exterior surface of the door bottom system 39 between the threshold assembly 40 and the door sweep 112. The at least one fin 128 will be described in greater detail below.

In the present application, the drainage plane 74 is at least partially defined by the rail channel 64, the channel passageway 66, the sill channel 98, and the drainage passageway 70, of the rail 72 and the sill 42, as shown in FIGS. 2-5 and 8. More specifically, the rail channel 64, the channel passageway 66, the sill channel 98, and the drainage passageway 70 collectively direct the flow of fluid that penetrates past the exterior surface of the door bottom system 39 toward the exterior 24 of the structure 22.

A person having ordinary skill in the art will appreciate that the term "drainage plane" is a term of art pertaining to the fluid flow path as described above, and does not require that the drainage plane 74 have a planar configuration. For example, as shown the Figures, the drainage plane 74 is non-planar. However, one having skill in the art will appreciate that the drainage plane 74 could be planar without escaping the scope of the present invention.

As shown in FIGS. 2-5 and 8, the rail channel 64, the channel passageway 66, the sill channel 98, and the drainage passageway 70 are each fluidly coupled with the exterior 24 of the structure 22. Therefore, by the fluid coupling, the barometric pressure in each of the rail channel 64, the channel passageway 66, the sill channel 98, and the drainage passageway 70 is equivalent. The equivalent barometric pressures allows for flow of the fluid by way of gravity from the highest point (i.e., the rail channel 64) to the lowest point (i.e., the drainage passageway 70) without resistance due to barometric pressure differential. Moreover, the fluid coupling between the rail channel 64, the channel passageway 66, the sill channel 98, and the drainage passageway 70 allows for continuous equalization of the barometric pressure. Therefore, in the event of a high localized barometric pressure (such as wind load against the entryway system 20), the barometric pressure throughout the system equalizes to the high localized barometric pressure to facilitate flow of the fluid along the drainage plane 74. As such, the fluid moves along the drainage plane 74 toward the exterior 24 of the structure 22 at all times, regardless of any barometric pressure changes.

As shown in FIG. 1, the threshold assembly 40 may be disposed between the first and second door jambs 30, 32. The threshold assembly 40 may be disposed below the door panel 38 such that the threshold assembly 40 is disposed within the opening 34 opposite the door head 36 and extending toward each of the first and second door jambs 30, 32. It is to be appreciated that the threshold assembly 40 may be disposed anywhere within the opening 34.

As shown in FIGS. 1, 2, and 6, the sill 42 may extend between a first end 48 and a second end 50. Although not explicitly shown in FIGS. 3-5, 7, and 8, it is to be appreciated that the extension of the sill 42 to the first end 48 as described below is similar to the extension of the sill 42 to the second end 50 as shown in FIGS. 3-5, 7, and 8. Typically, the first end 48 of the sill 42 is adjacent the first door jamb 30 and the second end 50 is adjacent the second door jamb 32. More typically, the first end 48 abuts the first door jamb 30 and the second end 50 abuts the second door jamb 32. However, it is to be appreciated that one or both of the first and second ends 48, 50 may be spaced from the first and second door jambs 30, 32, respectively.

As shown in FIGS. 2-8, the sill 42 may comprise numerous components. Specifically, as shown in the Figures, the sill 42 may comprise a sill base 56, a sill deck 58 disposed above and coupled to the sill base 56, and a nosing 60 extending upwardly toward the door sweep 112 in the second position. As an alternative, the sill base 56 and the nosing 60 may be a single component. As another alternative, the sill 42 may be a one-piece sill 42 which comprises a single component. It is to be appreciated that the sill 42 may comprise any number of components.

As shown in FIGS. 2-8, the sill 42 has a tread surface 52 adjacent the exterior side 44 and extending toward the interior side 46 with the tread surface 52 sloped downwardly away from the interior side 46 of the sill 42 for positively draining the fluid off of the sill 42. More specifically, when present, the sill deck 58 may have the tread surface 52. The slope of the tread surface 52 promotes positive drainage of the fluid that may contact the tread surface 52. Said differently, the slope of the tread surface 52 directs the fluid from the threshold assembly 40 toward the exterior 24 of the structure 22. Positive drainage typically refers to a desired drainage path of the fluid whereas negative drainage typically refers to an undesired drainage path of the fluid. For example, positive drainage is the movement of the fluid away from the interior 26 of the structure 22 and toward the exterior 24 of the structure 22, and negative drainage is the movement of the fluid away from the exterior 24 of the structure 22 and toward the interior 26 of the structure 22.

The tread surface 52 may also define a plurality of grooves 54 spaced from and parallel to one another and extending longitudinally along the sill 42. The grooves 54 collect and direct the fluid, which poses a slipping hazard to a person stepping on the tread surface 52.

As shown in FIGS. 3-5, 7, and 8, the sill 42 may have a dam 68 adjacent the tread surface 52 and extending upwardly for blocking backflow of the fluid across the tread surface 52 of the sill 42 and into the interior 26 of the structure 22. The dam 68 may partially define the sill channel. More specifically, the dam 68 may be spaced from and substantially parallel with the drainage wall 62 of the rail 72 with drainage wall 62 and the dam 68 defining opposing sides of the sill channel 98. When present, the sill deck 58 may have the dam 68. Therefore, the sill deck 58 may at least partially define the sill channel 98.

As set forth in the present application, the term "backflow" refers to a type of negative drainage. As an example, backflow is when the fluid is forced from the exterior side 44 of the sill 42 toward the interior side 46 of the sill 42. Such backflow may occur due to wind forcing the fluid up the tread surface 52.

Typically, the dam 68 extends longitudinally between the first and second door jambs 30, 32. The dam 68 extends into the opening 34 and blocks backflow of the fluid across the tread surface 52 of the sill 42 and into the interior 26 of the structure 22. Moreover, the sill 42 may define a midline M oriented longitudinally along the sill 42 and configured to be centered beneath a door panel 38 of the entryway system 20. The dam 68 may be disposed between the midline M and the interior side 46 of the sill 42 to position the drainage plane 74 proximate the interior side 46 of the sill 42 for positively draining the fluid off of the sill 42 that permeated toward the interior side 46. More specifically, the dam 68 may partially define the sill channel 98 and may thereby at least partially position the sill channel 98 between the midline M and the interior side 46 of the sill 42; positioning the sill channel 98 under a large portion of the door panel 38. As such, the rail channel 64 may in-turn be at least partially positioned between the midline M and the dam 68 and thus collect fluid that permeates farther between the door sweep 112 and the threshold assembly 40 toward the interior 26 of the structure 22. One having skill in the art will appreciate that the dam 68 may be positioned anywhere along the sill 42 without escaping the scope of the present invention.

The rail 72 may extend between a pair of rail ends 76. Moreover, the rail 72 may extend entirely between the first and second ends 48, 50 of the sill 42. It is to be appreciated that the rail ends 76 of the rail 72 may be spaced from one or both of the first and second ends 48, 50 of the sill 42. It is also to be appreciated that the rail 72 may extend past the sill deck 58 or the sill base 56. The rail 72 is typically spaced from each of the first and second door jambs 30, 32. However, the rail 72 may extend to and contact one or both of the first and second door jambs 30, 32.

As shown in FIGS. 2-8, a portion of the sill deck 58 and the sill base 56 may be disposed beneath the rail 72. Said differently, the sill deck 58 and the sill base 56 may extend out from underneath the rail 72. The rail 72 may have a locking wall 82 spaced from and substantially parallel to the drainage wall 62. The drainage wall 62 and the locking wall 82 may extend entirely along the sill 42 between the first and second ends 48, 50. However, it is to be appreciated that the drainage wall 62 and the locking wall 82 may extend along only a portion of the sill 42.

The sill 42 may be disposed between, and in engagement with, the drainage wall 62 and the locking wall 82 to couple the rail 72 to the sill 42. More specifically, as shown in FIGS. 3-5, 7, and 8, the sill deck 58 may define the dam 68 extending between the drainage wall 62 and the locking wall 82 of the rail 72 to couple the rail 72 to the sill deck 58. Said differently, the dam 68 extends between the drainage and locking walls 62, 82 and abuts the rail 72 at an end. The engagement of the dam 68 with the rail 72 prevents excessive flexing if a load is applied to the rail 72 downwardly toward the sill 42.

The dam 68 may be disposed between the drainage wall 62 and the locking wall 82. Moreover, the dam 68 may be adjacent the locking wall 82 such that the dam 68 lies along the locking wall 82. The locking wall 82 may have a protrusion 78 extending in a first direction. Typically, the first direction is further defined as the protrusion 78 extending toward the exterior side 44 of the sill 42. The dam 68 may have a hump 80 extending in a second direction opposing the first direction. Typically, the second direction is further defined as the hump 80 extending toward the interior side 46 of the sill 42. The hump 80 is adjacent to the protrusion 78. More specifically, the hump 80 is disposed between the protrusion 78 and the end of the dam 68.

Likewise, the drainage wall 62 may have a protrusion 84 extending in the second direction. The sill 42 may have a hump 86 extending in the first direction. The hump 86 is adjacent to the protrusion 84. More specifically, the protrusion 84 may be disposed between the hump 86 and the tread surface 52 of the sill deck 58.

The protrusions 78, 84 and the humps 80, 86 engage to retain the coupling of the rail 72 with the sill deck 58. It is to be appreciated that the protrusions 78, 84 and the humps 80, 86 may extend in any direction and may have any suitable configuration for retaining the coupling of the rail 72 with the sill 42.

As shown in FIGS. 3-5, 7, and 8, the rail 72 may have an engagement wall 88. The engagement wall 88 may extend between the drainage wall 62 and the locking wall 82. Moreover, the drainage wall 62 and the locking wall 82 may extend from engagement wall 88 down to the sill 42.

The engagement wall 88 of the rail 72 may define the rail channel 64 between the exterior side 44 and the interior side 46. The rail channel 64 may extend longitudinally along the rail 72 between and to the pair of rail ends 76. The rail channel 64 may open into the opening 34. One having skill in art will appreciate that the rail channel 64 may extend along a portion of the rail 72 and may open in any suitable direction.

As described above and shown in FIGS. 2-4 and 6, the door sweep 112 is disposed below and adapted to be coupled to the door panel 38, with the door sweep 112 movable between first and second positions corresponding with the open and closed positions of the door panel 38, respectively. The door sweep 112 selectively engages and seals against the rail 72, as will be described in greater detail below.

As shown in at FIGS. 2-4 and 6, the door sweep 112 is typically disposed longitudinally along, and coupled to, a lower surface 114 of the door panel 38. The door sweep 112 may comprise a sweep frame 118 adapted to be coupled to the door panel 38. The sweep frame 118 may extend longitudinally along the lower surface 114 of the door panel 38. Typically, the sweep frame 118 extends longitudinally along the entirety of the lower surface 114, as shown in FIGS. 1, 2, and 6; however, it is to be appreciated that the sweep frame 118 may extend longitudinally along a portion of the lower surface 114. Generally, the sweep frame 118 extends to an outside surface 122 of the door panel 38 facing the exterior 24 of the structure 22 when the door panel 38 is in the closed position and to an inside surface 124 of the door panel 38 facing the interior 26 of the structure 22 when the door panel 38 is in the closed position, as shown in FIG. 4.

As best shown in FIG. 4, the lower surface 114 of the door panel 38 may define at least one kerf 115. Typically, the at least one kerf 115 extends inwardly from the lower surface 114. Further, typically the at least one kerf 115 is defined longitudinally along the door panel 38. It is to be appreciated that the at least one kerf 115 defined by the door panel 38 may comprise a plurality of kerfs 115. Additionally, the door sweep 112 may comprise at least one leg 116 coupled to and extending from the sweep frame 118 of the door sweep 112 toward the door panel 38 for engaging the door panel 38 within the kerf 115 or kerfs 115. The at least one leg 116 extends longitudinally along the lower surface 114 of the door panel 38. Generally, engagement of the leg 116 with the door panel 38 within the at least one kerf 115 couples the door sweep 112 to the door panel 38. However, it is to be appreciated that the door sweep 112 may be coupled to the door panel 38 by any suitable method.

The door sweep 112 may comprise an outside seal 126. The outside seal 126 may extend longitudinally along the lower surface 114 of the door panel 38. Typically, the outside seal 126 extends longitudinally along the entirety of the lower surface 114; however, it is to be appreciated that the outside seal 126 may extend longitudinally along a portion of the lower surface 114. The outside seal 126 may extend angularly from the sweep frame 118 adjacent to the outside surface 122 away from the door panel 38 and toward the exterior side 44 of the sill 42. The outside seal 126 positively drains the fluid off of the outside surface 122 of the door panel 38 to prevent the infiltration of the fluid between the door panel 38 and the sill 42.

As described above, the door sweep 112 may comprise the least one fin 128, with the at least one fin 128 extending downwardly toward the sill 42 in a substantially linear configuration in the first position of the door sweep 112 and the open position of the door panel 38, as best shown in FIGS. 2-8. More specifically, the at least one fin 128 typically extends downwardly from the sweep frame 118 toward the sill 42. The at least one fin 128 may extend longitudinally along the lower surface 114 of the door panel 38. Typically, the at least one fin 128 extends longitudinally along the entirety of the lower surface 114; however, it is to be appreciated that the at least one fin 128 may extend longitudinally along a portion of the lower surface 114.

The door sweep 112 may abut along the engagement wall 88 of the rail 72 and prevent backflow of the fluid over the rail 72, which would result in negative drainage off of the rail 72 toward the interior side 46 of the sill 42. More specifically, as shown in FIG. 4, the at least one fin 128 of the door sweep 112 may abut along the engagement wall 88 of the rail 72 and prevent backflow of the fluid over the rail 72. The abutment of the at least one fin 128 with the engagement wall 88 may be further defined as the at least one fin 128 flexing such that a portion of the at least one fin 128 lies along and seals against the engagement wall 88. It is also to be appreciated that the at least one fin 128 may be spaced from the engagement wall 88 with the at least one fin 128 blocking a majority of the fluid from passing between the door panel 38 and the rail 72 toward the interior side 46 of the sill 42, and facilitating drainage of the fluid off of the outside surface 122 of the door panel 38 toward the rail 72 for positive drainage off of the sill 42.

Typically, the at least one fin 128 is further defined as a pair of fins 128. It is to be appreciated that the at least one fin 128 may be a single fin 128 or any number of fins 128.

When the pair of fins 128 is present, the fins 128 are typically spaced from one another and positioned toward the outside surface 122 of the door panel 38. It is to be appreciated that the pair of fins 128 may be adjacent to one another. Both of the pair of fins 128 may abut the engagement wall 88. It is to be appreciated that the one of the pair of fins 128 may be spaced from the engagement wall 88 while the other one of the pair of fins 128 may abut the engagement wall 88, as shown in FIG. 4. Furthermore, it is to be appreciated that both of the pair of fins 128 may be spaced from the engagement wall 88.

As shown in FIGS. 3 and 4, the door sweep 112 may comprise an engagement member 130 extending from the sweep frame 118 toward the sill 42 with the engagement member 130 extending along and abutting the rail 72 when the door sweep 112 is in the second position (i.e., the door panel 38 is in the closed position). More specifically, the engagement member 130 may engage a portion of the rail 72 on an opposite side of the rail channel 64 from the at least one fin 128. The rail 72 may have a seal corner 104 proximate the interior side 46 of the sill 42, with the engagement member 130 of the door sweep 112 abutting the rail 72 along the seal corner 104 when the door sweep 112 is in the second position. The abutment of the rail 72 with the seal corner 104 allows for deflection of the engagement member 130 in both horizontal and vertical directions. This deflection results in counteracting internal bias within the engagement member 130 to seal against the seal corner 104. The counteracting bias in both horizontal and vertical directions results in a secure abutment between the engagement member 130 to seal against the seal corner 104 that is resistant to slip and leakage. Furthermore, the seal corner 104 may have a seal surface 106 that is arcuate along an angle of at least 90 degrees, with the engagement member 130 of the door sweep 112 abutting the rail 72 along the entirety of the seal surface 106 when the door sweep 112 is in the second position. The abutment of the engagement member 130 along the arcuate seal surface 106 creates a large contact surface between the engagement member 130 and the rail 72 for sealing between the threshold assembly 40 and the door sweep 112.

The engagement member 130 may extend longitudinally along the lower surface 114 of the door panel 38. Typically, the engagement member 130 extends longitudinally along the entirety of the lower surface 114; however, it is to be appreciated that the engagement member 130 may extend longitudinally along a portion of the lower surface 114.

As best shown in FIGS. 3-5, 7, and 8, the engagement member 130 extends between exterior and interior ends 131, 133, with the engagement member 130 having a first section 132 extending from the exterior end 131 and a second section 134 extending from the interior end 133. Each of the first and second sections 132, 134 extend downwardly from the sweep frame 118 toward the sill 42 and interconnect at a position spaced from the sweep frame 118.

The engagement member 130 and the at least one fin 128 may at least partially comprise a flexible material allowing the engagement member 130 and the at least one fin 128 to seal against the engagement wall 88 of the rail 72.

Returning to the sill 42, the sill 42 defines the sill channel 98 between the exterior side 44 and the interior side 46. The sill channel 98 may extend longitudinally between the first and second ends 48, 50 of the sill 42. One having skill in art will appreciate that the sill channel 98 may extend along a portion of the sill 42 and may open in any suitable direction.

As shown in FIGS. 2-8, the engagement wall 88 of the rail 72 may define the channel passageway 66. Moreover, the engagement wall 88 may define the channel passageway 66 along a bottom of the rail channel 64 such that the channel passageway 66 opens into each of the rail channel 64 and the sill channel 98.

The channel passageway 66 may be positioned at one of the rail ends 76 of the rail 72. Furthermore, the channel passageway 66 may be further defined as a pair of channel passageways 66, with the channel passageways 66 individually positioned at the rail ends 76 of the rail 72. One having skill in the art will appreciate that the channel passageway 66 may be any number of channel passageways 66 positioned anywhere along the rail 72 for fluidly connecting the rail channel 64 with the sill channel 98.

As shown in FIGS. 3-5, 7, and 8, and described above, the channel passageway 66 is defined through the engagement wall 88 to fluidly connect the rail channel 64 with the sill channel 98. Moreover, with the channel passageway 66 at one of the rail ends 76 of the rail 72, the engagement wall 88 may define a transverse opening of the channel passageway 66 with the transverse opening facing the adjacent doorjamb. Therefore, the channel passageway 66 may be further defined as a notch 100 at one of the rail ends 76 of the rail 72, which opens toward the adjacent door jamb 30, 32. The transverse opening ensures that the fluid located at the rail end 76 of the rail 72 flows from the rail channel 64 to the sill channel 98 (i.e., the transverse opening prevents the fluid from being retained in the rail channel 64).

Furthermore, the channel passageway 66 may have an at least partially semi-circular configuration. One having skill in the art will appreciate that the channel passageway 66 may have any shape, position, and configuration along the rail 72 without escaping the scope of the present invention.

The rail 72 and the rail channel 64 may have a substantially horizontal orientation. Alternatively, the rail 72 and the rail channel 64 may be sloped toward the channel passageway 66 to facilitate drainage of the fluid from the rail channel 64 to the sill channel 98. More specifically, with the channel passageway 66 further defined as the pair of channel passageways 66 individually positioned at the rail ends 76 of the rail 72, the rail 72 and the rail channel 64 may slope downwardly toward each of the pair of rail ends 76 (i.e., a middle portion of the rail 72 may be higher than the pair of rail ends 76 of the rail 72). Even more specifically, the engagement wall 88 of the rail 72, which defines the rail channel 64, may slope downwardly toward each of the pair of rail ends 76 to facilitate drainage of the fluid toward the channel passageways 66 at the pair of rail ends 76 and to facilitate drainage through the pair channel passageways 66 from the rail channel 64 to the sill channel 98. One having skill in the art will appreciate that the rail 72, or any portion thereof, may have any slope or combination of slopes in any direction.

Similarly, the sill 42 and the sill channel 98 may have a substantially horizontal orientation. Alternatively, the sill 42 and the sill channel 98 may be sloped toward the drainage passageway 70 to facilitate drainage through the drainage passageway 70. More specifically, the sill 42 and the sill channel 98 may be sloped toward the exterior 24 of the structure 22 to facilitate drainage through the drainage passageway 70. One having skill in the art will appreciate that the sill 42, or any portion thereof, may have any slope or combination of slopes in any direction.

As described above and shown in FIGS. 2-5, the drainage wall 62 defines the drainage passageway 70 fluidly connected with the sill channel 98 for permitting flow of the fluid from the sill channel 98 to the exterior side 44 of the sill 42. More specifically, the drainage passageway 70 permits flow of the fluid from the sill channel 98 to the tread surface 52, which may be angled toward the exterior side 44 of the sill 42.

As shown in FIGS. 2-5, the drainage passageway 70 may have a substantially rectangular configuration. The sill 42 may define a bottom 102 of the sill channel 98, with the drainage passageway 70 substantially flush with the bottom 102 of the sill channel 98 for aligning the drainage passageway 70 with the sill channel 98 and permitting flow of the fluid from the sill channel 98 to the exterior side 44 of the sill 42. Said differently, each of the drainage passageway 70 and the bottom 102 of the sill channel 98 have a lowest height measured from the floor upon which the threshold assembly 40 is disposed. The lowest heights of the drainage passageway 70 and the bottom 102 of the sill channel 98 are equal. As such, as the fluid flows into and begins to fill the sill channel 98, the fluid flows through the drainage passageway 70 to drain the fluid toward the exterior side 44 of the sill 42. One having skill in the art will appreciate that the drainage passageway 70 may have any suitable shape.

As shown in FIG. 2, the drainage passageway 70 may be a pair of drainage passageways 70, with the drainage passageways 70 spaced from one another and individually positioned toward the opposing rail ends 76. Said differently, one of the drainage passageways 70 is positioned proximate one of the rail ends 76 and the other one of the drainage passageways 70 is positioned proximate the other one of the rail ends 76. In one embodiment, the drainage passageways 70 are spaced ten inches or less from the respective proximate rail ends 76. In another embodiment, the drainage passageways 70 are spaced six inches or less from the respective proximate rail ends 76. One having skill in the art will appreciate that the drainage passageway 70 may be any number of drainage passageways 70 positioned anywhere along the rail 72 for permitting flow of the fluid from the sill channel 98 to the exterior side 44 of the sill 42.

The rail channel 64, the channel passageway 66, the sill channel 98, and the drainage passageway 70 collectively prevent the intrusion of the fluid between the threshold assembly 40 and the door sweep 112 into the interior 26 of the structure 22. More specifically, fluid that infiltrates between the rail 72 and the at least one fin 128 of the door sweep 112 enters the rail channel 64. The fluid flows from the rail channel 64 through the channel passageway 66 into the sill channel 98. The fluid then flows from the sill channel 98 through the drainage passageway 70 and down the tread surface 52 of the sill 42 to the exterior 24 of the structure 22, preventing intrusion of the fluid into the interior 26 of the structure 22.

As shown in FIGS. 6-8, the threshold assembly 40 may further comprise a cover plate 90 coupled to the rail 72 and selectively covering the drainage passageway 70. More specifically, the cover plate 90 may comprise a cover plate body 92 having a substantially planar configuration. The cover plate body 92 may be engageable with the drainage wall 62 of the rail 72 about the drainage passageway 70 for selectively sealing the drainage passageway 70.

As shown in FIG. 7, the cover plate 90 may further comprise a pair of pins 94 extending in opposing directions from the cover plate body 92. The rail 72 may further comprise a pair of knuckles 96 extending from the rail 72 on opposing sides of the drainage passageway 70. The pair of knuckles 96 are configured to individually receive the pair of pins 94. The cover plate 90 is pivotally coupled to the rail 72 through the engagement of the pair of pins 94 with the pair of knuckles 96. One having skill in the art will appreciate that pins 94 and the knuckles 96 may be any number of pins 94 and knuckles 96 and that the cover plate 90 may be pivotally coupled to the rail 72 in any suitable manner.

As shown in FIG. 8, the cover plate 90 may pivot outwardly away from the rail 72 to uncover the drainage passageway 70. More specifically, the cover plate 90 pivots due to pressure differentials on opposing sides of the cover plate 90 (i.e., the side facing the drainage passageway 70 and the side facing the exterior 24 of the structure 22). When the pressure is equal on the opposing sides of the cover plate 90 or greater on the side facing the exterior 24, the cover plate 90 lies against and seals the drainage passageway 70. When the pressure is greater on the side facing the drainage passageway 70, the cover plate 90 pivots away from the rail 72 to open the drainage passageway 70.

As such, the cover plate 90 normally closes the drainage passageway 70 when pressures on opposing sides of the cover plate 90 are equal. As pressure builds on the side of the cover plate 90 facing the drainage passageway 70 (such as when the fluid accumulates in the sill channel 98 and presses against the cover plate 90) the cover plate 90 pivots away from the rail 72. Pivoting of the cover plate 90 away from the rail 72 allows the fluid to flow through the drainage passageway 70 toward the exterior side 44 of the sill 42. As pressure builds on the side of the cover plate 90 facing the exterior 24 of the structure 22 (such as when wind blows against the cover plate 90) the cover plate 90 seals against the rail 72. As such, the cover plate 90 prevents the pressure from the exterior 24 of the structure 22 from forcing any water in the sill channel 98 from flowing over the dam 68 of the sill 42 and into the interior 26 of the structure 22.

The invention has been described in an illustrative manner, and it is to be understood that the terminology which has been used is intended to be in the nature of words of description rather than of limitation. As is now apparent to those skilled in the art, many modifications and variations of the subject invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A threshold assembly for use with an entryway system disposed within an aperture of a structure, which has an exterior and an interior, said threshold assembly comprising:

a sill extending along an axis between an exterior side for facing the exterior of the structure and an interior side for facing the interior of the structure, with said sill at least partially defining a sill channel between said exterior side and said interior side which is adapted for accepting a fluid therein; and a rail coupled to and disposed above said sill, with said rail having a drainage wall adjacent said exterior side of said sill and cooperating with said sill to at least partially define said sill channel, and with said rail at least partially defining a rail channel between said exterior side and said interior side and above said sill channel, said rail channel being adapted to accept the fluid therein;

wherein said rail defines a channel passageway which fluidly connects said rail channel and said sill channel for permitting flow of the fluid from said rail channel to said sill channel;

wherein said drainage wall defines a drainage passageway fluidly connected with said sill channel for permitting flow of the fluid from said sill channel to said exterior side of said sill, with said rail channel, said channel passageway, said sill channel, and said drainage passageway at least partially defining a drainage plane for permitting flow of the fluid from said rail channel to said exterior side of said sill;

wherein said sill has a tread surface adjacent said exterior side and extending toward said interior side with said tread surface sloped downwardly away from said interior side of said sill for positively draining the fluid off of said sill;

wherein said sill has a dam adjacent said tread surface and extending upwardly for blocking backflow of the fluid across said tread surface of said sill and into the interior of the structure; and wherein said sill defines a midline oriented longitudinally along said sill and configured to be centered beneath a door panel of the entryway system, with said dam disposed between said midline and said interior side of said sill to position said drainage plane proximate said interior side of said sill for positively draining the fluid off of said sill that permeates toward said interior side.

2. The threshold assembly as set forth in claim 1, wherein said sill defines a bottom of said sill channel, with said drainage passageway substantially flush with said bottom of said sill channel for aligning the drainage passageway with the sill channel and permit flow of the fluid from said sill channel to said exterior side of said sill.

3. The threshold assembly as set forth in claim 1, wherein said rail extends between a pair of rail ends.

4. The threshold assembly as set forth in claim 3, wherein said drainage passageway is a pair of drainage passageways, with said drainage passageways spaced from one another and individually positioned toward said opposing rail ends.

5. The threshold assembly as set forth in claim 4, wherein said drainage passageways are spaced ten inches or less from said respective proximate rail ends.

6. The threshold assembly as set forth in claim 3, wherein said channel passageway is positioned at one of said rail ends of said rail.

7. The threshold assembly as set forth in claim 6, wherein said channel passageway is further defined as a notch at said one of said rail ends of said rail.

8. The threshold assembly as set forth in claim 6, wherein said channel passageway is further defined as a pair of channel passageways, with said channel passageways individually positioned at said rail ends of said rail.

9. The threshold assembly as set forth in claim 1, further comprising a cover plate coupled to said rail and selectively covering said drainage passageway.

10. The threshold assembly as set forth in claim 9, wherein said cover plate pivots outwardly away from said rail to uncover said drainage passageway.

11. The threshold assembly as set forth in claim 9, wherein said cover plate includes a cover plate body having a substantially planar configuration that is engageable with said drainage wall of said rail about said drainage passageway to selectively seal said drainage passageway.

12. The threshold assembly as set forth in claim 11, wherein said cover plate further include a pair of pins extending in opposing directions from said cover plate body and said rail further includes a pair of knuckles extending from said rail on opposing sides of said drainage passageway, with said pair of knuckles configured to individually receive said pair of pins and pivotally couple said cover plate with said rail.

13. The threshold assembly as set forth in claim 1, wherein said drainage passageway is disposed above said tread surface and permits flow of the fluid from said sill channel to said tread surface.

14. A door bottom system for use with an entryway system disposed within an aperture of a structure, which has an exterior and an interior, with the entryway system having a door panel capable of moving between an open position and a closed position, said door bottom system comprising:

a door sweep disposed below and adapted to be coupled to the door panel, with said door sweep movable between first and second positions corresponding with the open and closed positions of the door panel, respectively; and a threshold assembly disposed below said door sweep in said second position, said threshold assembly comprising:

a sill extending along an axis between an exterior side for facing the exterior of the structure and an interior side for facing the interior of the structure, with said sill at least partially defining a sill channel between said exterior side and said interior side which is adapted for accepting a fluid therein; and a rail coupled to and disposed above said sill, with said rail having a drainage wall adjacent said exterior side of said sill and cooperating with said sill to at least partially define said sill channel, and with said rail at least partially defining a rail channel between said exterior side and said interior side and above said sill channel, said rail channel being adapted to accept the fluid therein;

wherein said rail defines a channel passageway which fluidly connects said rail channel and said sill channel for permitting flow of the fluid from said rail channel to said sill channel;

wherein said drainage wall defines a drainage passageway fluidly connected with said sill channel for permitting flow of the fluid from said sill channel to said exterior side of said sill, with said rail channel, said channel passageway, said sill channel, and said drainage passageway at least partially defining a drainage plane for permitting flow of the fluid from said rail channel to said exterior side of said sill;

wherein said door sweep comprises a sweep frame adapted to be coupled to the door panel and an engagement member extending from said sweep frame toward said sill, with said engagement member extending along and abutting said rail when said door sweep is in said second position;

wherein said rail has a seal corner proximate said interior side of said sill, with said engagement member of said door sweep abutting said rail along said seal corner when said door sweep is in said second position; and wherein said seal corner has a seal surface that is arcuate along an angle of at least 90 degrees, with said engagement member of said door sweep abutting said rail along the entirety of said seal surface when said door sweep is in said second position.

* * * * *